US005673526A

United States Patent [19]

Schiedegger et al.

[11] Patent Number: 5,673,526

[45] Date of Patent: Oct. 7, 1997

[54] COMPONENT GABLE VENT APPARATUS AND METHOD OF ASSEMBLING SAME

[75] Inventors: Charles E. Schiedegger, Metamora; Aundrea Nurenberg, Lapeer; Michael C. Clark, Columbiaville, all of Mich.

[73] Assignee: Tapco International, Plymouth, Mich.

[21] Appl. No.: 494,446

[22] Filed: Jun. 26, 1995

[51] Int. Cl.[6] ..... E06B 7/08

[52] U.S. Cl. ..... 52/473; 52/198; 52/199

[58] Field of Search ..... 52/473, 198, 199, 52/656.7, 656.5, 656.2, 457, 456

[56] References Cited

U.S. PATENT DOCUMENTS

| | | | |
|---|---|---|---|
| 2,828,711 | 4/1958 | Smith et al. | 52/473 |
| 3,968,738 | 7/1976 | Matzke | 52/473 X |
| 4,560,114 | 12/1985 | Schmidts et al. | 252/71.8 |
| 4,785,596 | 11/1988 | Wiley et al. | 52/198 |
| 4,875,318 | 10/1989 | MacLeod et al. . | |
| 5,349,799 | 9/1994 | Schiedegger et al. . | |

OTHER PUBLICATIONS

New Concept Louvers™, the Perfect match. (date unknown).

Mid–America Building Products pamphlet, 1995.

*Primary Examiner*—Wynn E. Wood

*Assistant Examiner*—Timothy B. Kang

*Attorney, Agent, or Firm*—Harness, Dickey & Pierce, P.L.C.

[57] ABSTRACT

A building vent assembly comprising a plurality of individually extruded plastic vent components that have been cut to a desirable length and pitch for a particular size and shape vent.

17 Claims, 6 Drawing Sheets

Fig. 5
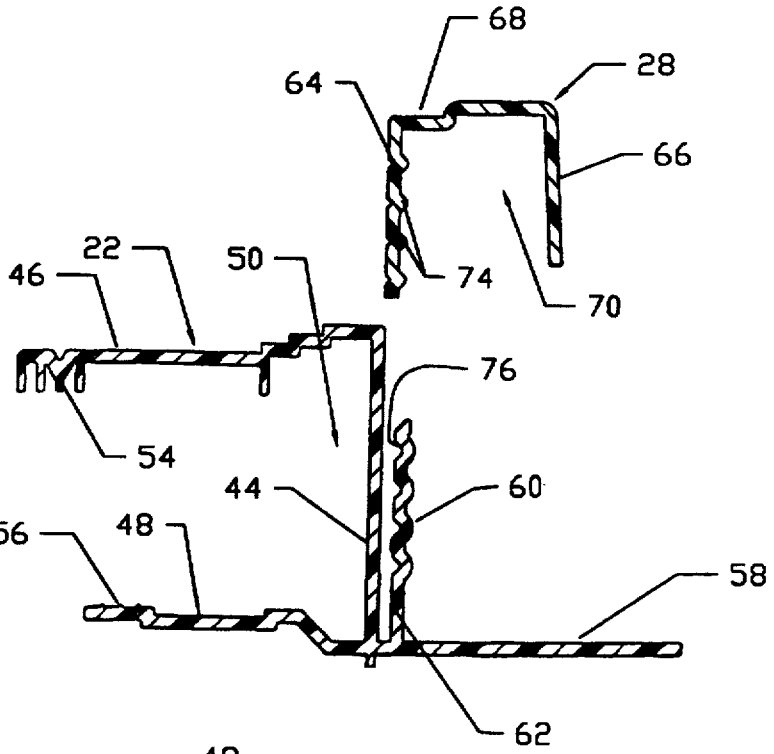
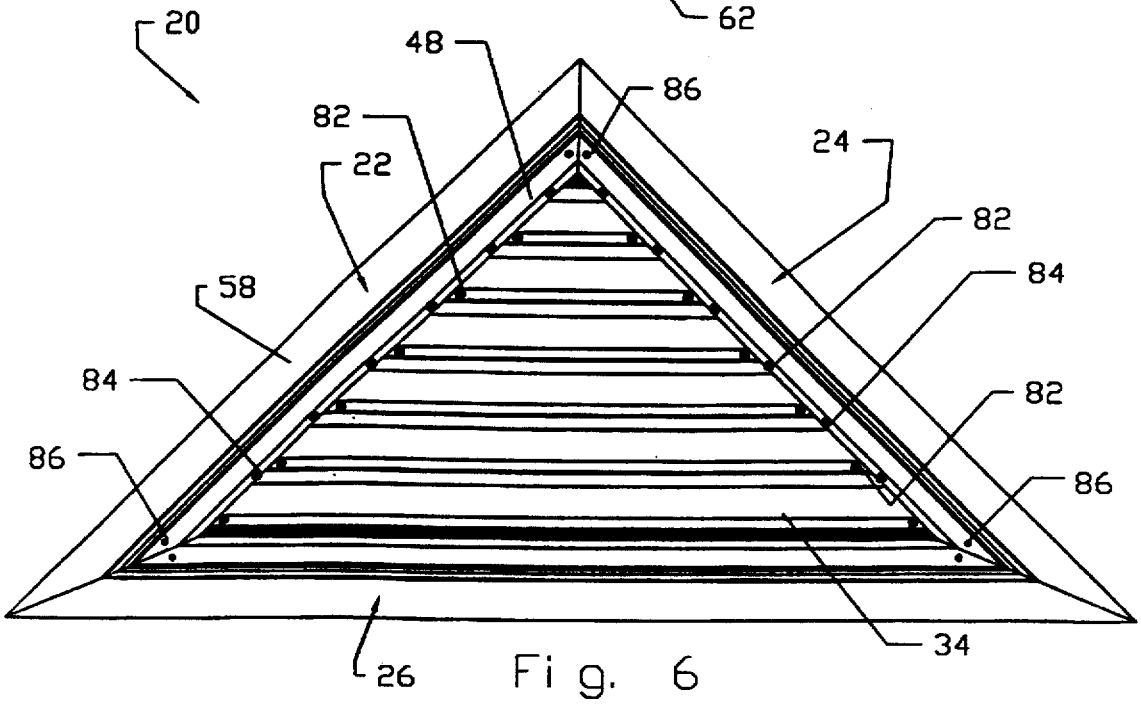
Fig. 6

128b 128a
132
134
136

120b 120a
122
124
126
130b

130a

120d

120c

COMPONENT GABLE VENT APPARATUS AND METHOD OF ASSEMBLING SAME

BACKGROUND OF THE INVENTION

1. Field of the Invention

This invention relates generally to a plastic building vent and, more particularly, to a plastic gable vent that is an assembly of plastic components where the plastic components can be specially cut and assembled for various shapes and sizes of vents.

2. Discussion of the Related Art

Building vents that are made of plastic and are specially designed and fabricated to aesthetically accent different building designs are known in the art. For specific plastic gable vents of this type, see for example, U.S. Pat. No. 5,349,799 issued Sep. 27, 1994 to Schiedegger et al. and U.S. Pat. No. 4,875,318 issued Oct. 24, 1989 to McLeod et al. Gable vents have been known to come in various shapes including triangular, square, octagonal, diamond, etc. Known gable vents of these types are generally single piece plastic units that have been injection molded to a particular size and shape for each different type vent. The single piece plastic vent unit usually includes a plurality of integrally molded louvers that allow ventilation into the interior of the building.

U.S. patent application Ser. No. 08/277,734 filed Jul. 20, 1994 titled PLASTIC BUILDING PART, assigned to the assignee of the instant application, and herein incorporated by reference discloses a plastic building product of the type being discussed herein. The plastic building product of this application includes a plastic body having a plurality of parallel integrally formed louvers. The plastic body includes extended securing flanges that allow the body to be secured to the building by nails. Exterior siding panels of the building are then secured to an outer wall of the building that cover the securing tabs of the plastic body. A plurality of flange segments are then secured to the plastic body in a slidable engagement to cover ends of the siding panels adjacent to the body to provide a more pleasing appearance. The flange segments are secured to the body in a controllable manner to accommodate different thicknesses of different siding panels.

A drawback exists in the types of plastic gable vents of the prior art. Particularly, the prior art gable vents are generally single units that may include a separate outer ring connectable to the unit to hide the ends of the siding panels. For this type of vent, the single unit is molded so that all of the different parts of the vent are integrally formed. Therefore, for every different size and/or different shape vent, a different mold is required. Because plastic gable vents are generally low cost items, and injection molds are very expensive items, the need to provide different molds for each different vent significantly adds to the cost of the vent.

What is needed is a selection of different vent components that have been separately fabricated and can be selectively cut to desirable lengths and angles for different shapes and sizes of gable vents. It is therefore an object of the present invention to provide such a selection of vent components.

SUMMARY OF THE INVENTION

In accordance with the teachings of the present invention, a building vent assembly is disclosed that is made of a plurality of individually formed plastic vent components that have been cut to a desirable length and pitch for a particular size and shape vent. The vent components include side rails, ring segments and louvers that have been separately formed by a suitable plastic forming process, and then secured together in different configurations. Once the individual vent components have been cut to the desirable length and pitch, the components are then assembled and secured together by appropriate securing mechanisms such as staples and/or ultrasonic welds.

Additional objects, advantages and features of the present invention will become apparent from the following description and appended claims, taken in conjunction with the accompanying drawings.

BRIEF DESCRIPTION OF THE DRAWINGS

FIG. 5 shows a sectional view of a portion of the vent of FIG. 1 where a ring component of the vent is separated from a rail component;

FIG. 6 is a back view of the gable vent of FIG. 1 showing ultrasonic welding locations.

DETAILED DESCRIPTION OF THE PREFERRED EMBODIMENTS

The following discussion of the preferred embodiments directed to various gable vent assemblies is merely exemplary in nature and is in no way intended to limit the invention or its applications or uses.

Figure 1:
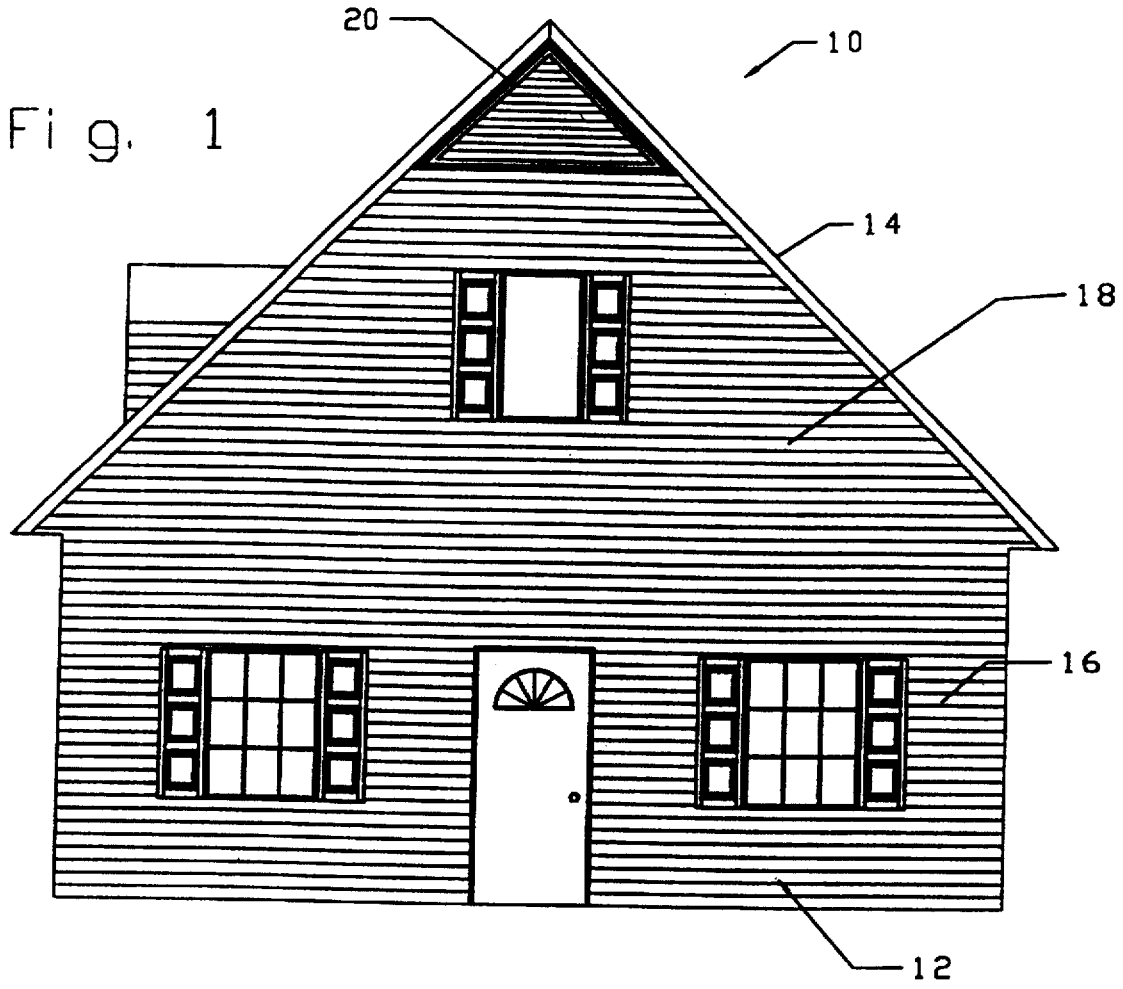
FIG. 1 is a front view of a building including a gable vent according to an embodiment of the present invention.

FIG. 1 shows a front view of a building 10 having a front wall 12 and a pitched roof 14. A series of protective siding panels 16 make up an outer wall layer of the front wall 12. The configuration and angle of the pitched roof 14 defines a gable 18 in the front wall 12, as shown. Typically, a top area of the gable 18 encloses an attic (not shown) within the building 10 that has to be ventilated to reduce moisture build-up and the like that can cause significant damage to the roof 14. In accordance with the teachings of the present invention, a plastic gable vent 20 is provided in the gable 18 to ventilate the attic of the building 10 in a manner well understood in the art. The gable vent 20 has a triangular-shape vent having an outer triangular ring defined by three straight edges. As will become apparent from the discussion below of the various embodiments of the present invention, other shaped gable vents can be provided to ventilate the attic that are comprised of different length straight outside edges defining different shaped outer rings within the scope of the present invention.

Figure 2:
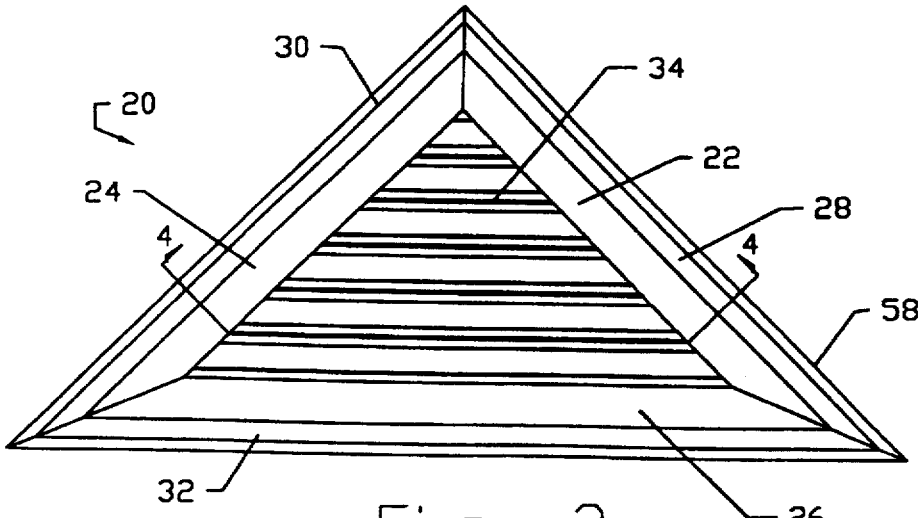
FIG. 2 is a front plan view of the gable vent shown in FIG. 1 separate from the building.
Figure 3:
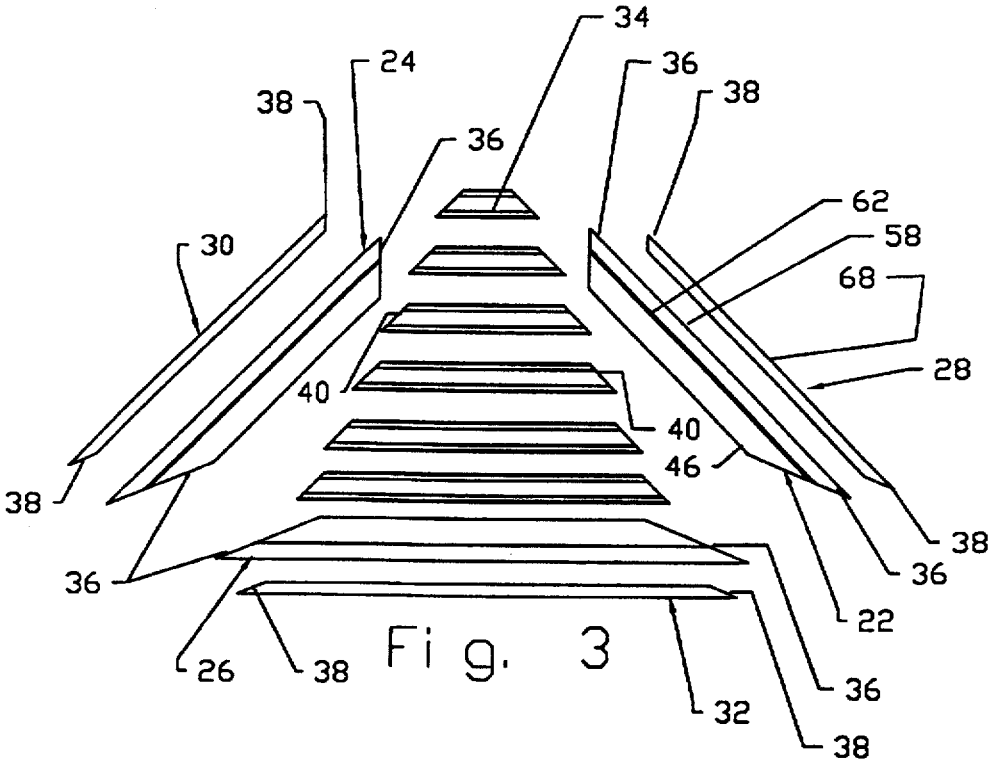
FIG. 3 is a blown apart front view of the gable vent shown in FIG. 1.

FIG. 2 shows a front plan view and FIG. 3 shows an exploded plan view of the gable vent 20. As shown, the gable vent 20 includes an assembly of three side rails 22, 24 and 26, three ring segments 28, 30 and 32, and a plurality of louvers 34, here six louvers. As will be discussed in more detail below, the ring segment 28 is secured to the side rail 22, the ring segment 30 is secured to the side rail 24, and the ring segment 32 is secured to the side rail 26 after the gable vent 20 is secured to the gable 18 in order to hide ends of the siding panels 16 adjacent to the gable vent 20. Each of the side rails 22-26, ring segments 28–32 and louvers 34 are fabricated from an appropriate plastic such as polypropylene or polystyrene.

The side rails 22–26 are individual plastic members that have been extruded to a desirable and aesthetically pleasing shape by an extrusion mold (not shown) in conformance with a particular vent design. Extrusion is a well known plastic fabrication process. Other plastic fabrication processes may be applicable within the scope of the invention. The side rails 22–26 are then cut to a desirable length, and ends 36 of the rails 22–26 are cut at appropriate angles so that when the side rails 22–26 are joined at the ends 36, as shown, the particular size and shape vent 20 is formed. Likewise, the ring segments 28–32 are also individual plastic members that have been extruded to a desirable shape, and then cut appropriately so that angled ends 38 of the ring segments 28–32 join when the ring segments 28–32 are secured to the side rails 22–26. Further, the plurality of louvers 34 are also individual plastic members that have been extruded to a desirable shape, and then cut to a desirable length having angled ends 40 so that a series of different length louvers 34 are provided to fit the configuration of the vent 20 as shown.

Figure 4:
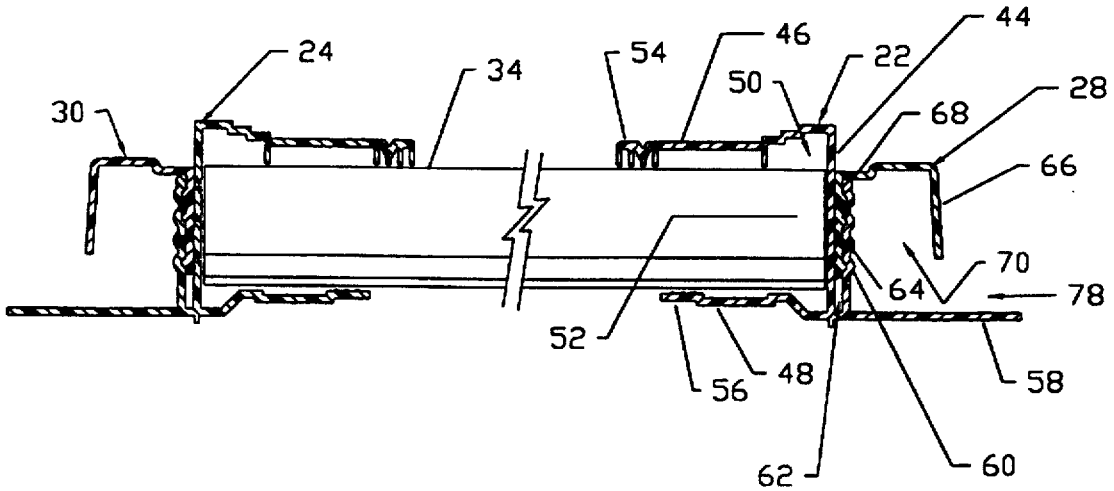
FIG. 4 is a sectional view through lines 4—4 of the gable vent in FIG. 2.

FIG. 4 shows a sectional view of the vent 20 through line 4—4 of FIG. 2, and FIG. 5 shows a sectional view of the side rail 22 and the ring segment 28 separated from each other. The side rail 22 and the corresponding ring segment 28 will be discussed with reference to FIGS. 4 and 5 with the understanding that the other side rails 24 and 26, and other ring segments 30 and 32, are configured identically. The side rail 22 includes a base portion 44 from which extends two side walls 46 and 48 that define a channel 50 therebetween. A louver 34 is shown slidably engaged within the channel 50 between the side walls 46 and 48 such that an end 52 of the louver 34 is positioned adjacent to the base portion 44. Each louver 34 of the vent 20 is slid within the channel 50 between the side rails 22 and 24 in this manner. The louver 34 rests against welding ribs 54 extending from the side wall 46 and a welding edge 56 of the side wall 48. The ribs 54 and the edge 56 provide surfaces to ultrasonically weld the side rail 22 to the louver 34 as will be discussed in more detail below.

A nailing flange 58 extends from the base portion 44 opposite to the side wall 48. The nailing flange 58 extends beyond the ring segment 28, and provides a surface that lays against and is secured to the gable 18, generally by nailing, to secure the vent 20 to the building 10. Siding panels 16 will lay over the nailing flange 58 when the vent 20 is secured to the gable 18. A securing leg 60 extends perpendicularly from the nailing flange 58 parallel to the base portion 44 to define a slot 62 between the leg 60 and the base portion 44, as shown. The ring segment 28 includes a first ring side wall 64 and a second ring side wall 66 extending from a ring base portion 68 to define a channel 70 therebetween. The side wall 64 is appropriately dimensioned to slidably engage within the slot 62 between the securing leg 60 and the base portion 44 to secure the ring member 28 to the side rail 22. The side wall 64 includes a series of extending nubs 74 that interlock with grooves 76 that are part of the leg 60 to secure the ring segment 28 to the side rail 22 as shown. Such an interlocking engagement between the ring segment 28 and the side rail 22 allows the ring segment 28 to be positioned at different locations relative to the nailing flange 58 to accommodate different thicknesses of siding panels 16 that will be inserted within an opening 78 between the nailing flange 58 and the ring segment 28. A more detailed depiction of this type of engagement between side rails and ring segments can be found in U.S. patent application Ser. No. 08/277,734 referenced above.

Because the gable vent 20 is an assembly of separately molded plastic parts, it is necessary to rigidly secure the parts together. FIG. 6 shows a rear view of the vent 20 that depicts welding points for a series of ultrasonic welds that act to secure the assembly of the side rails 22–26 and the louvers 34 together. Particularly, ultrasonic welding points 82 represent locations where the louvers 34 are ultrasonically welded to the ribs 54 of the side wall 46, and ultrasonic welding points 84 represent locations where the louvers 34 are ultrasonically welded to the edge 56 of the side wall 48. Ultrasonic welding points 86 represent locations where the side rails 22–26 are welded together. The ends 36 of adjacent side rails 22–26 are positioned next to each other, and a scrap piece of plastic (not shown) is positioned against the side walls 48 within the channels 50 of the adjacent side rails 22–26 to join the side rails 22–26 together by the welds at the welding points 86. By securing the side rails 22–26 to the louvers 34 in this manner, the side rails 22–26 are configured relative to each other in a desirable manner. The ring segments 28–32 are secured to the side rails 22–26 in the manner as discussed above after the vent 20 is attached to the gable 16. Securing of the different components of the vent 20 by ultrasonic welding is shown by way of a preferred embodiment, but as will be appreciated by those skilled in the art, other suitable mechanisms, such as staples, can be incorporated to secure the different components together.

Figure 7A:
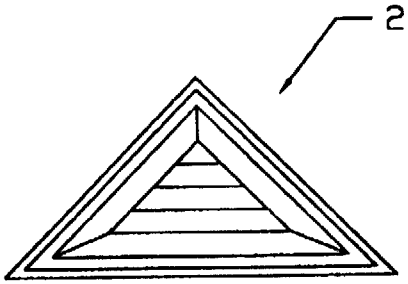
FIGS. 7–14 show various other configurations of gable vents according to the invention.
Figure 7B:
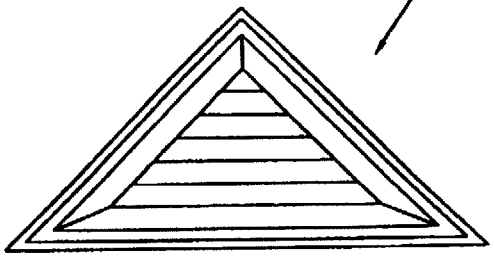
Figure 7C:
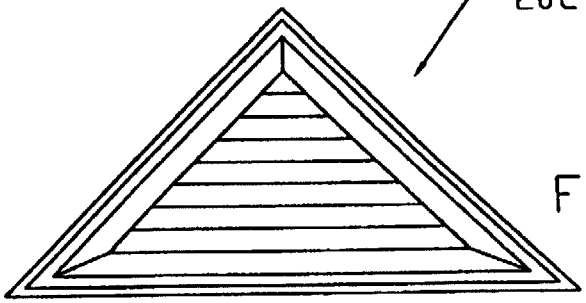

As mentioned above, the individually formed plastic components of the gable vents of the invention can be used to form a number of different sized and shaped vents having an outer ring defined by different length straight edges. As is apparent from a careful study of the invention, the side rails 22–26, the ring segments 28–32, and the louvers 34 can be cut to appropriate lengths having appropriately angled ends to form side rails and ring segments of suitable dimensions for a variety of different sized and shaped vents. For example, FIG. 7(*a*)–7(*c*) show three different triangular gable vents 20*a*, 20*b*, and 20*c*, respectively, of differing sizes made from the same side rails, ring segments, and louvers as the gable vent 20, above, but in which the length of the side rails, ring segments and louvers, as well as the pitch of the connecting angles between the individual components, are varied for the particular sized vent.

Figure 8A:
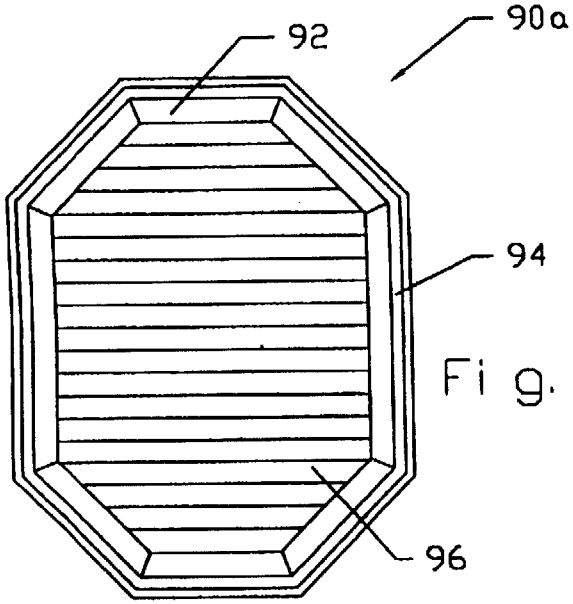
Figure 8B:
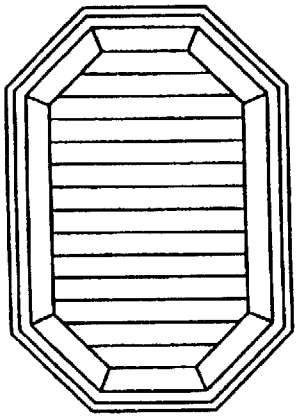

Still, the same side rails, ring segments and louvers can be used to form different shaped gable vents if these components are cut correctly. FIGS. 8(*a*)–8(*b*) show another embodiment of gable vents 90*a* and 90*b*, respectively, that define an outer ring of an elongated octagonal shape. The vent 90*a* includes eight side rails 92, eight ring segments 94 and a suitable number of louvers 96 appropriately cut to form the vent assemblies as shown in these figures.

Figure 9C:
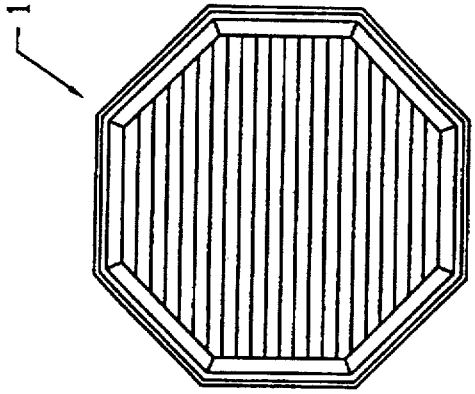
Figure 9B:
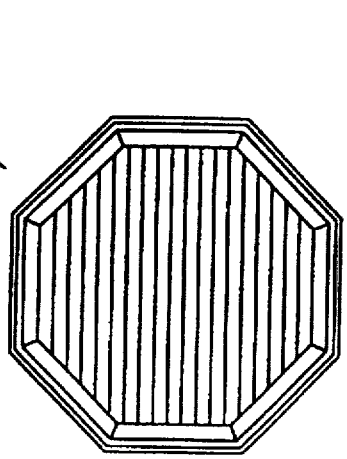
Figure 9A:
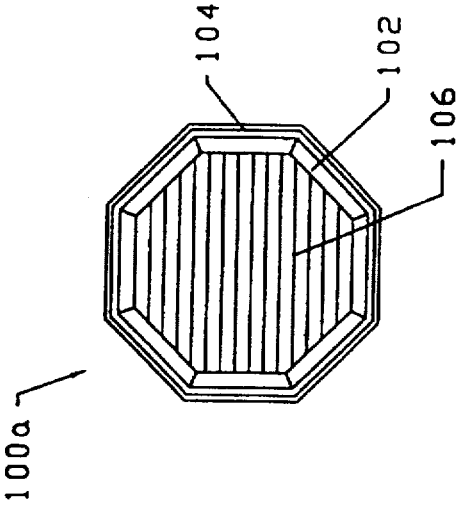

Likewise, FIGS. 9(*a*)–9(*c*) show three octagonal shaped vents 100*a*, 100*b* and 100*c*, respectively, of three different sizes, where each vent 100*a*–100*c* includes eight side rails 102, eight ring segments 104, and a plurality of louvers 106 whose number depends on the size of the vent.

Figure 11B:
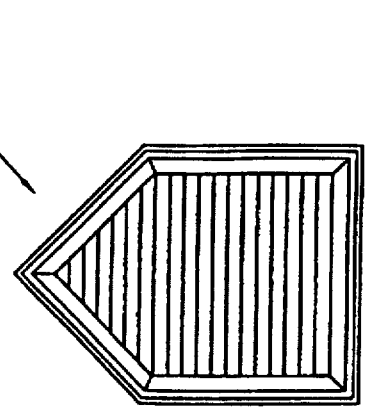
Figure 11A:
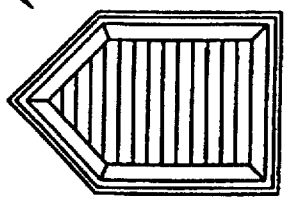
Figure 10B:
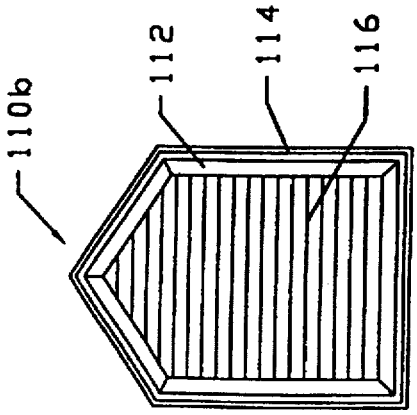
Figure 10A:
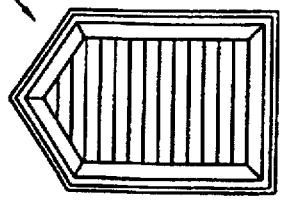

FIGS. 10(*a*)–10(*b*) and FIGS. 11(*a*)–11(*b*) show various size and shaped gable vents 110*a*–110*d*, respectively, referred to as massive peaked louver vents in the art. The vents 110*a*–110*d* include five side rails 112, five ring segments 114, and a plurality of louvers 116 whose number depends on the size of the vent.

Figures 12A, 12B, 12C, 12D, 13A, 13B, 14A, 14B:
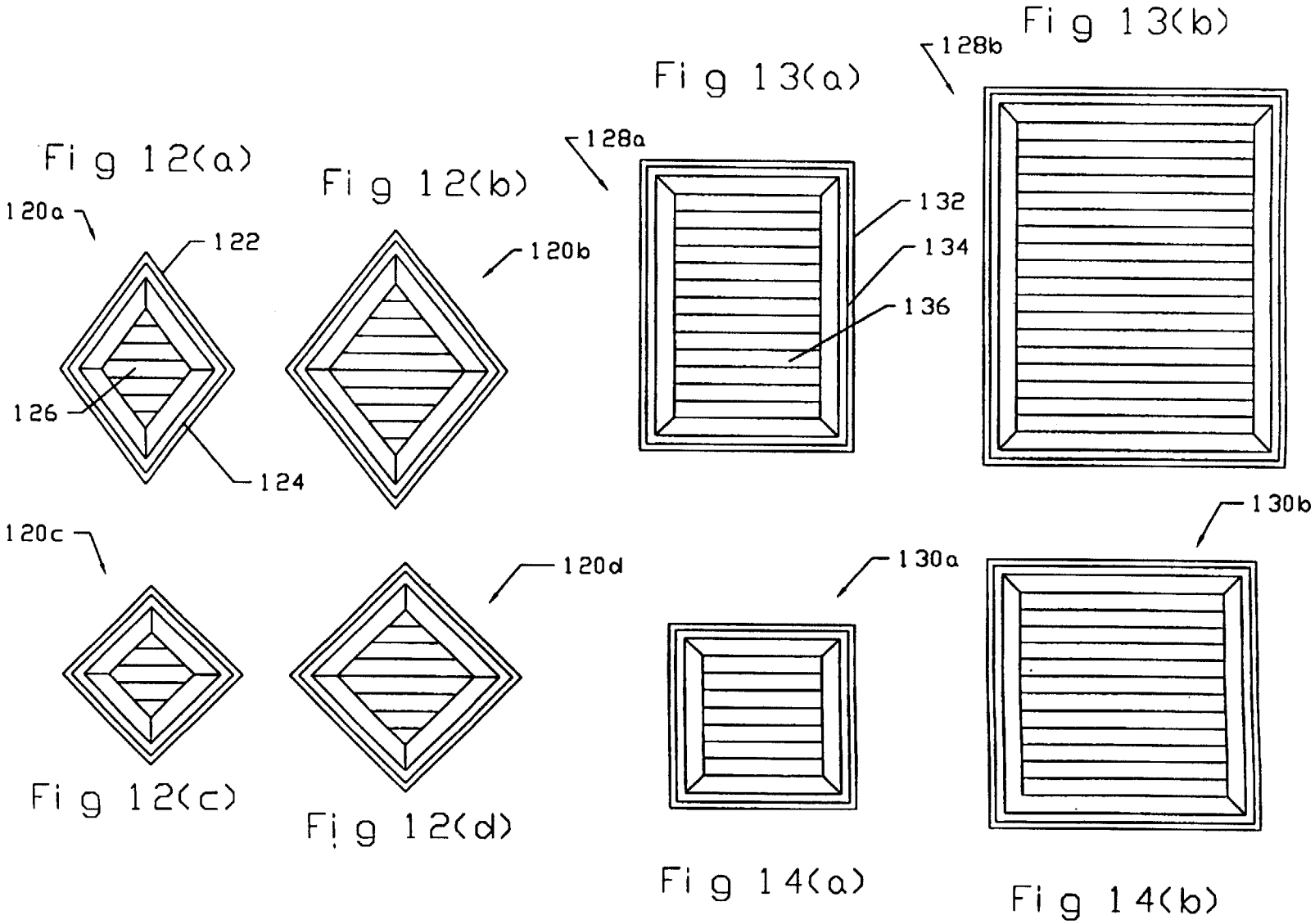

FIGS. 12(*a*)–12(*d*) show four different diamond shaped gable vents 120*a*, 120*b*, 120*c* and 120*d*, respectfully. The diamond shape gable vents 120*a*–120*d* are each made of differing length side rails 122, ring segments 124 and an appropriate number of louvers 126.

FIGS. 13(*a*)–13(*b*) show two different size rectangular shaped vents 128*a* and 128*b*, respectfully, and FIGS. 14(*a*)–14(*b*) show two different size square gable vents 130*a* and 130*b*, respectfully. The gable vents 128*a*, 128*b*, 130*a* and 130*b* include side rails 132, ring segments 134 and a plurality of louvers 136 that have all been cut to the appropriate length and pitch for the particular size and shape vent. Each of the different shaped gable vents, as well as other sizes and shape of gable vents can be assembled in the manner as discussed above including side rails, ring segments and appropriate number of louvers within the scope of the invention.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A building vent comprising:

a plurality of separate plastic side rails assembled and secured together to form a ring structure, each of said side rails including a first side rail wall, a second side rail wall, and a side rail base portion forming a C-shaped side rail channel, said first side wall including a first welding portion formed integral with the first side wall and defining a series of welding ribs, and said second side wall including a second welding portion that is substantially planar and formed integral with the second side wall; and a plurality of separate plastic louvers positioned within the side rail channels of opposing side rails to be in contact with the first welding portion of the first side wall and the second welding portion of the second side wall, said louvers being secured to the side rails by ultrasonic welds at the first and second welding portions, wherein the separate side rails and louvers are selectively cut to a desirable length and pitch for a particular size and shape vent to form the ring structure into any one of a plurality of different geometric shapes prior to the vent being secured to a building.

2. The building vent according to claim 1 wherein the plurality of separate plastic side rails are three separate plastic side rails assembled together to form a triangular shaped ring structure defining a triangular shaped vent.

3. The building vent according to claim 1 wherein the plurality of separate plastic side rails are eight separate plastic side rails having substantially the same length and assembled together to form an octagonal-shaped ring structure defining an octagonal shaped vent.

4. The building vent according to claim 1 wherein the plurality of separate plastic side rails are eight separate plastic side rails where a first and second of the side rails have a first length, a third, fourth, fifth and sixth of the side rails have a second length where the second length is shorter than the first length, and a sixth and seventh of the side rails have a third length where the third length is shorter than the second length, and wherein the eight side rails are assembled together to form an elongated octagonal-shaped ring structure where the first and second side rails form parallel side portions of the ring structure and the seventh and eighth side rails form parallel end portions of the ring structure.

5. The building vent according to claim 1 wherein the plurality of separate plastic side rails are five separate plastic side rails assembled together to form a massive peaked vent where a top portion of the massive peaked vent includes two side rails defining a triangle and a bottom portion of the massive peaked vent includes three side rails defining a rectangle.

6. The building vent according to claim 1 wherein the plurality of separate plastic side rails are four separate plastic side rails assembled together to form a diamond shaped ring structure defining a diamond shape vent.

7. The building vent according to claim 1 wherein the plurality of separate plastic side rails are four separate plastic side rails assembled together to form a rectangular shaped ring structure defining a rectangular shaped vent.

8. The building vent according to claim 1 wherein the plurality of separate plastic side rails and the plurality of separate plastic louvers are formed by a plastic extrusion process.

9. The building vent according to claim 1 wherein the means for securing is a series of ultrasonic welds, said ultrasonic welds securing each of the separate plastic louvers to at least two of the separate plastic side rails.

10. The building vent according to claim 1 wherein the building vent is a gable vent.

11. The building vent according to claim 1 further comprising a plurality of separate ring segments where a separate ring segment is secured to each side rail.

12. The building vent according to claim 11 wherein the ring segments are positioned to cover siding panels attached to a building, said ring segments being adjustably secured to the side rails so as to accommodate siding panels of differing thicknesses.

13. A building vent comprising:

a plurality of separate plastic side rails assembled and secured together to define a ring structure, each of said side rails including a first side rail wall, a second side rail wall, and a side rail base portion forming a C-shaped side rail channel, said first side wall including a first welding portion formed integral with the first side wall and defining a series of welding ribs, and said second side wall including a second welding portion that is substantially planar and formed integral with the second side wall;

a plurality of separate plastic louvers positioned within the side rail channels of opposing side rails to be in contact with the first welding portion of the first side wall and the second welding portion of the second side wall, said louvers being secured to the side rails by ultrasonic welds at the first and second welding portions; and a plurality of separate plastic ring segments where a separate ring segment is secured to each side rail, wherein the separate side rails, louvers and ring segments are selectively cut to length and pitch for a particular size and shape vent to define the ring structure into any one of a variety of different geometric shapes.

14. The building vent according to claim 13 wherein the ring segments are positioned to cover siding panels of a building, said ring segments being adjustably secured to the side rails so as to accommodate siding panels of different thicknesses.

15. The building vent according to claim 13 wherein the plurality of separate plastic side rails and the plurality of separate plastic ring segments are formed by a plastic extrusion process.

16. A method of providing a building vent having a predetermined shape, said method comprising the steps of:

extruding a length of a first plastic vent component, said first plastic vent component including a first side rail wall, a second side rail wall, and a side rail base portion forming a C-shaped side rail channel, said first side wall including a first welding portion formed integral with the first side wall and defining a series of welding ribs, and said second side wall including a second welding portion that is substantially planar and formed integral with the second side wall;

cutting the first extruded plastic vent component into a plurality of vent side rails of predetermined lengths, said step of cutting the side rails including cutting ends of each of the side rails at predetermined angles depending on the predetermined shape;

extruding a length of a second plastic vent component;

cutting the second extruded plastic vent component into a plurality of louvers having predetermined lengths, said step of cutting the louvers including cutting ends of each of the louvers at predetermined angles depending on the predetermined shape;

assembling the vent so that the plurality of cut plastic side rails define the predetermined shape of the vent, said step of assembling including positioning the louvers within the side rail channels of opposing side rails to be in contact with the first welding portion of the first side wall and the second welding portion of the second side wall and ultrasonically welding the louvers to the side rails at the first and second welding portions.

17. The method according to claim 16 further comprising the steps of extruding a length of a third vent component and cutting the third extruded vent component into a plurality of vent ring segments of predetermined lengths, said step of cutting the third component into a plurality of ring segments including cutting the ring segments to a length and angle that conforms with the side rails.

* * * * *